US006095931A

United States Patent [19]

Hettinger et al.

[11] Patent Number: 6,095,931

[45] Date of Patent: Aug. 1, 2000

[54] BI-MATERIAL GOLF CLUB HEAD HAVING AN ISOLATION LAYER

[75] Inventors: Ronald K. Hettinger, Oceanside; J. Neil Hall, Carlsbad; Augustin W. Rollinson; Kamal Sarkar, both of San Diego, all of Calif.

[73] Assignee: Callaway Golf Company, Carlsbad, Calif.

[21] Appl. No.: 09/222,237

[22] Filed: Dec. 28, 1998

[51] Int. Cl.[7] ..... A63B 53/04

[52] U.S. Cl. ..... 473/341; 473/349

[58] Field of Search ..... 473/324, 341, 473/349

[56] References Cited

U.S. PATENT DOCUMENTS

| | | | |
|---|---|---|---|
| 1,320,163 | 10/1919 | Fitzmaurice . | |
| 1,525,352 | 2/1925 | Aitken . | |
| 1,535,270 | 4/1925 | Tyler . | |
| 1,543,691 | 6/1925 | Beat . | |
| 1,840,451 | 1/1932 | Jansky . | |
| 2,034,936 | 3/1936 | Barnhart . | |
| 2,534,947 | 12/1950 | Bright . | |
| 3,064,980 | 11/1962 | Steiner . | |
| 3,547,445 | 12/1970 | Hardesty . | |
| 3,567,228 | 3/1971 | Lynn . | |
| 3,571,900 | 3/1971 | Hardesty . | |
| 3,659,855 | 5/1972 | Hardesty . | |
| 4,451,042 | 5/1984 | Hayashi et al. . | |
| 4,540,178 | 9/1985 | Johnson et al. . | |
| 4,607,846 | 8/1986 | Perkins . | |
| 4,792,140 | 12/1988 | Yamaguchi et al. . | |
| 4,801,146 | 1/1989 | Honma . | |
| 4,804,188 | 2/1989 | McKee et al. . | |
| 4,812,187 | 3/1989 | Honma . | |
| 4,884,812 | 12/1989 | Nagasaki et al. . | |
| 5,176,383 | 1/1993 | Duclos . | |
| 5,198,062 | 3/1993 | Chen . | |
| 5,277,423 | 1/1994 | Artus . | |
| 5,299,807 | 4/1994 | Hutin . | |
| 5,316,298 | 5/1994 | Hutin et al. . | |
| 5,342,812 | 8/1994 | Niskanen et al. . | |
| 5,354,059 | 10/1994 | Stuff . | |
| 5,405,137 | 4/1995 | Vincent et al. . | |
| 5,439,223 | 8/1995 | Kobayashi . | |
| 5,570,886 | 11/1996 | Rigal et al. | 473/345 |
| 5,586,947 | 12/1996 | Hutin | 473/324 |
| 5,776,010 | 7/1998 | Helmstetter et al. | 473/334 |
| 5,938,543 | 8/1999 | McGeeney et al. | 473/349 X |

*Primary Examiner*—John A. Ricci
*Attorney, Agent, or Firm*—Michael A. Catania

[57] ABSTRACT

A bimetallic golf club head having a weight body for lowering the center of gravity of the golf club head in order to increase vertical gear effect upon impact with a golf ball, while also providing for an isolation layer between the golf club head's weight body and a main body portion comprising a ball striking front section. One purpose of the isolation layer is to isolate, or reduce the combination of, the impact vibration frequency pattern of the main body and the vibration frequency pattern of the weight body, thereby preserving the desirable feel and playability of a single metal golf club head while enjoying the improved performance of a low center of gravity golf club head. Another purpose of the isolation layer is to minimize or reduce the galvanic/intermetallic reaction between two different metallic materials that are placed in direct contact.

46 Claims, 3 Drawing Sheets

BI-MATERIAL GOLF CLUB HEAD HAVING AN ISOLATION LAYER

FIELD OF THE INVENTION

The present invention relates to golf clubs, and more specifically to a golf club head having an isolation layer positioned between two dissimilar club head materials for improving feel and playability.

BACKGROUND OF THE INVENTION

Because of the importance of the putting game to a golfer's overall score, there have been, and always will be, efforts to design a superior putter. A superior putter design should incorporate subjective characteristics such as feel and playability, as well as objective characteristics such as performance. Golf manufacturers will typically rely upon player testing and feedback in order to achieve optimum feel and playability in the putter, while relying upon quantitative measurements to confirm actual improvements in performance.

It is commonly understood and accepted by golfers that when putting a golf ball, the golf ball will roll more accurately and consistently if the initial backspin or skidding of the golf ball is minimized or eliminated, since backspin or skidding can cause the golf ball to travel in an unpredictable manner. Once the golf ball stops spinning backwards and/or skidding, and begins to roll in a forward direction, the golf ball will follow a more predictable path.

By designing putters with a lower center of gravity, manufacturers have been able to create putters that are more likely to impart a forward spin component to a putted golf ball. This can be explained by what is known as a vertical gear effect. The term gear effect is commonly used and understood in the industry. As a brief explanation of this effect, one can visualize a side view of a golf ball on the left hand side of a reference frame being impacted by a putter head coming from the right hand side of the reference frame. The impact point on the putter face is above the center of gravity of the putter head. Since the center of gravity is below the impact point, the torque forces will cause the putter head to rotate generally about the impact point in a clockwise direction, as viewed in the above-described reference frame, due to the location of the center of gravity. (Likewise, if the center of gravity were positioned above the impact point, the torque forces would cause the putter head to rotate generally about the impact point in a counterclockwise direction, as viewed in the above-described reference frame.) With the putter head rotating in a clockwise direction while the golf ball is in contact with the putter face, the putter face and golf ball will counter-rotate relative to one another, similar to two adjacent gears in a machine. Therefore, since the clockwise rotation of the putter head results in a clockwise rotation of the putter face, a counter-rotation on the golf ball will result in a counterclockwise rotation of the golf ball. Based upon the orientation of the reference frame described above, this counterclockwise rotation of the golf ball would be viewed as a forward rotation component.

As manufacturers have attempted to design putter heads having a lower center of gravity in order to achieve the desired vertical gear effect, manufacturers realized that limiting the putter head to a single material either made it difficult to get the center of gravity low enough, or to achieve a desirably proportioned putter head. Accordingly, manufacturers began utilizing materials of differing densities in order to design putter heads having a lower center of gravity, while retaining traditional proportions in a putter head design.

In an effort to design a superior putter, the inventors in the present application attempted to provide superior subjective characteristics by incorporating the commercially successful Stronomic® polymer insert into the putter face, while utilizing materials of differing densities in order to create a low center of gravity putter head that would produce the desirable vertical gear effect upon impact with a golf ball.

However, when such a design was player tested for feel and playability, a common complaint from the players was that the putter had a harsh or unpleasant feel. Efforts to determine the cause of this subjective characteristic have resulted in the present invention.

SUMMARY OF THE INVENTION

After extensive testing and analysis, the inventors concluded that a possible cause for the harsh or unpleasant feel of a putter utilizing materials of differing densities was that each material was producing a different vibration frequency pattern upon impact. This spectrum, or combination, of vibration frequencies was creating and transmitting a resultant frequency pattern to the player via a shaft and grip end of the putter (as sensory vibration) and via the air (as audible vibration, or sound). This resulting frequency spectrum, or pattern, was being perceived as harsh or unpleasant. Based upon this conclusion, one possible reason that single material putters were providing better feel and playability than putters utilizing materials of differing densities was that, in a single material putter, there was only one impact vibration frequency pattern being produced, and thus, no potential for an "unpleasant" combination of vibration frequency patterns (or in the case of insert putters, the combination of the vibration frequency patterns of the insert material and club head material was producing a "pleasant" resultant vibration frequency pattern).

Therefore, the inventors of the present invention designed a putter head utilizing materials of differing densities. However, in an effort to isolate, or prevent the combination of, the impact vibration frequency patterns of each of these materials, a preferred embodiment of the present invention incorporates an isolation layer placed between the materials of differing densities.

More specifically, in a preferred embodiment of the putter head design of the present invention, the putter head is comprised of stainless steel and tungsten. The isolation layer is comprised of urethane. In a preferred embodiment, the putter face is comprised of a polymer insert. Although putters with polymer face inserts are designed with materials of differing densities, it is believed that the combination of the impact vibration frequency patterns of stainless steel and a polymer insert creates a resultant vibration frequency pattern which is perceived as providing a pleasant feel, as indicated by player testing and by the commercial success of the Odyssey Stronomic® insert putters. It is understood that putters having face inserts are not limited to polymer face inserts. In addition to various polymers, the face insert material may comprise various ceramics or metals. The selection of a face insert material is based upon characteristics such as feel, playability and performance.

Upon designing and building a bi-material golf club head having an isolation layer, player testing was conducted to confirm that the subjective characteristics of this putter design were an improvement over previous designs. Regardless of whether or not the theorized reasons for the harsh or unpleasant feel of the prior design were correct, the results of player testing on the putter of the present invention confirmed that the placement of the isolation layer between materials having differing densities resulted in a putter having improved subjective characteristics such as feel and playability.

The isolation layer provides other benefits to bi-material golf club head design as well. When building prototype golf club heads having a bimetallic construction, wherein the two metallic regions are in direct contact, some prototype golf club heads displayed a galvanic/intermetallic reaction between the two metals. The severity of the reaction varied depending upon the compatibility of the metals that were in contact. This galvanic/intermetallic reaction created visible flaws in the appearance of the bimetallic golf club head at the junction of the two metals. Accordingly, an additional benefit of the isolation layer is to minimize or reduce the occurrence of this galvanic/intermetallic reaction between the two metals.

In addition to the isolation layer concept of the present invention, a preferred embodiment of the putter head incorporates a tri-faceted sole. Unlike the prior art which demonstrates various soles having facets in the heel-to-toe direction, the present preferred embodiment incorporates facets in the front-to-rear direction of the sole. The front and rear facets are angled upwards away from the center facet to prevent the leading edge or trailing edge from catching the putting surface. The center facet is located directly below the center of gravity of the putter head, and is angled in a manner such that when the putter head is laid down at ball address, the tendency of the putter head will be to rest on its center facet, thereby positioning the putter face at a preferred ball address position. The structure of this unique sole configuration is further illustrated in the attached drawings relating to the isolation layer concept.

Accordingly, it is an object of the present invention to describe a design for a putter head that exhibits superior subjective and objective characteristics. It is another object of the present invention to describe a design for a putter head that exhibits superior feel, playability and performance. A further object of the present invention is to describe a design for a putter head having a low center of gravity in order to achieve a desired vertical gear effect. Another object of the present invention is to describe a design for a putter head that utilizes materials of differing densities, while minimizing the combination of impact vibration frequency patterns from each of the materials by placing an isolation layer in between these materials of differing densities.

DETAILED DESCRIPTION OF THE INVENTION

Like numbers are used throughout the detailed description of the invention to designate like elements of the golf club head of the present invention.

Figure 1:
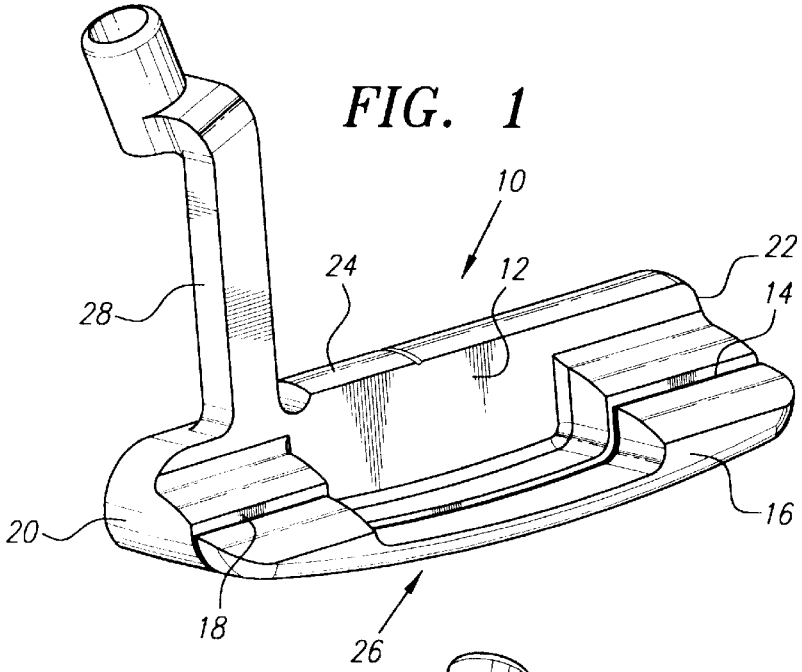
FIG. 1 is a rear perspective view of a golf club head of the present invention showing a preferred embodiment of an isolation layer between a main body and a weight body.

FIG. 1 is a rear perspective view of a golf club head 10 comprising a main body 12, an isolation layer 14 and a weight body 16. The main body 12 is made of a first material having a first density and the weight body 16 is made of a second material having a second density which is greater than the first density. In a preferred embodiment, the first material is stainless steel having a density of approximately 7.8 grams/cc, the second material is a tungsten alloy having a density of approximately 17 grams/cc, and the isolation layer 14 is a urethane. Depending upon the desired position of the center of gravity of the club head 10, and in a preferred embodiment, the weight body 16 can comprise anywhere from 5% of the weight of the main body 12 up to 300% of the weight of the main body 12, i.e., wherein the weight body 16 weighs three times as much as the main body, and any percentage in between.

As discussed above, the function of the isolation layer 14 is to minimize the combination of the impact vibration frequency patterns of the main body 12 and weight body 16. The thickness of the isolation layer 14 may vary depending upon the effectiveness of the selected material in isolating, or minimizing the combination of, multiple impact vibration frequency patterns. Any material capable of providing this function, including various polymers, metals and ceramics, may be used as a preferred material for the isolation layer 14.

Figure 5:
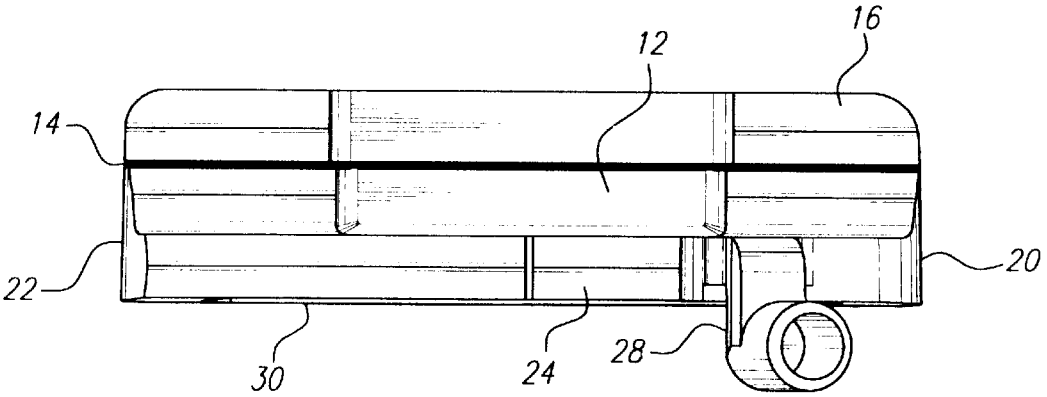
FIG. 5 is a top view of the golf club head of the present invention.
Figure 6:
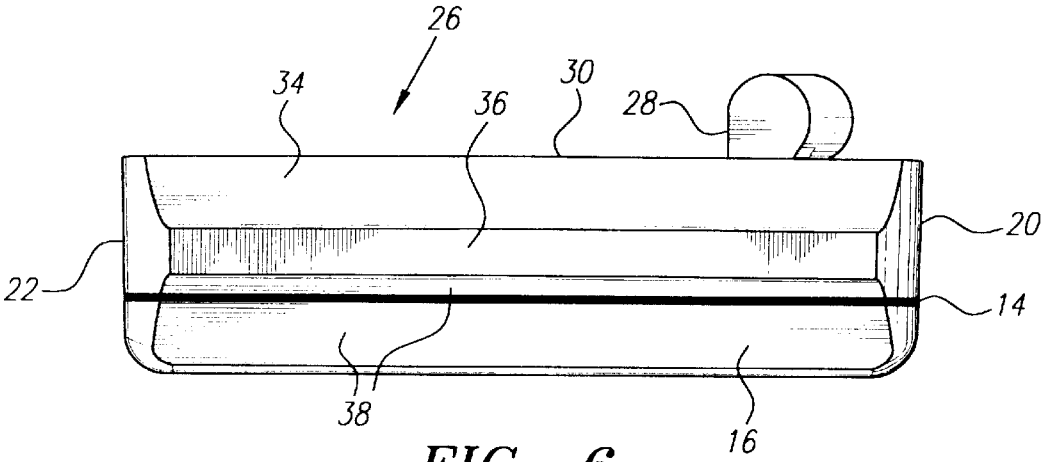
FIG. 6 is a bottom view of the golf club head of the present invention.
Figure 7:
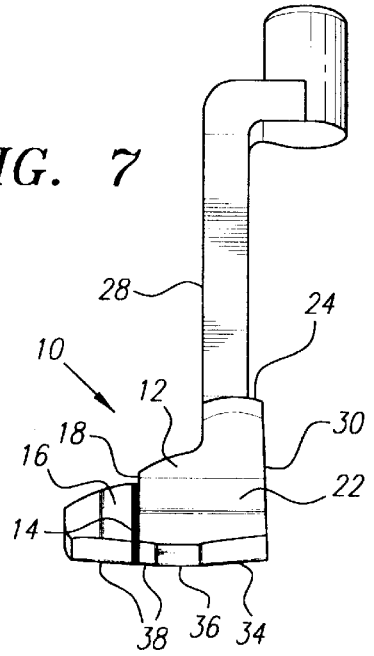
FIG. 7 is a toe view of the golf club head of the present invention.
Figure 8:
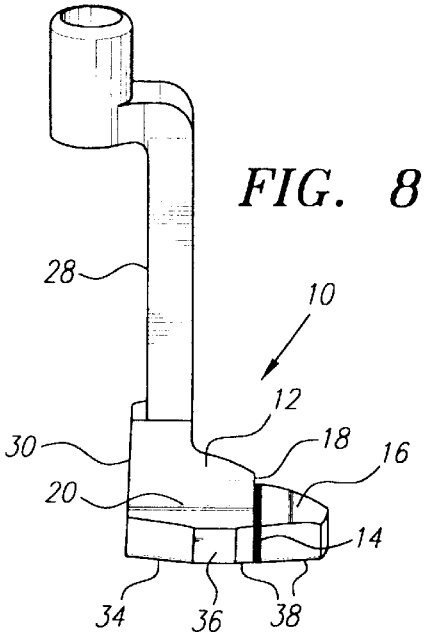
FIG. 8 is a heel view of the golf club head of the present invention.

In a preferred material, a preferred thickness of the urethane isolation layer 14 is between 0.020 and 0.100 inches, and more preferably between 0.030–0.040 inches, and most preferably, approximately 0.035 inches thick. The thinness of the isolation layer 14 is a function of the effectiveness of the material selected, as discussed above. However, the thickness of the isolation layer 14 may be dictated in part by aesthetics. Since the isolation layer 14 may be manufactured in a color which is visibly distinct from the main body 12 and the weight body 16, it may be desirable to use a thickness that provides pleasing aesthetics to the club head 10. For example, in a top view of the club head 10 (as shown in FIG. 5), the isolation layer 14 is visible and parallel to the intended path of the club head 10. Thus, the thickness of the isolation layer 14 may be varied for purposes of providing a visible alignment device for the user.

The club head 10 of the present invention further comprises a rear section 18 of the main body 12, a heel section 20, a toe section 22, a top section 24, a bottom section 26, and a hosel 28. The hosel 28 is for connecting the club head 10 to a shaft (not shown). It is understood that the main body 12 and weight body 16 of the club head 10 may be comprised of one or more independent portions. For example, the weight body 16 may be comprised of multiple independent pieces, such as a heel portion (not shown) and a toe portion (not shown) attached to the main body 12 as two separate portions. In such an embodiment, the isolation layer 14 would correspondingly be implemented to provide isolation between the one or more various main body 12 and weight body 16 portions. Thus, the term "main body" 12 and "weight body" 16 is intended to cover embodiments where the main body 12 comprises one or more portions and/or where the weight body 16 comprises one or more portions.

Figure 2:
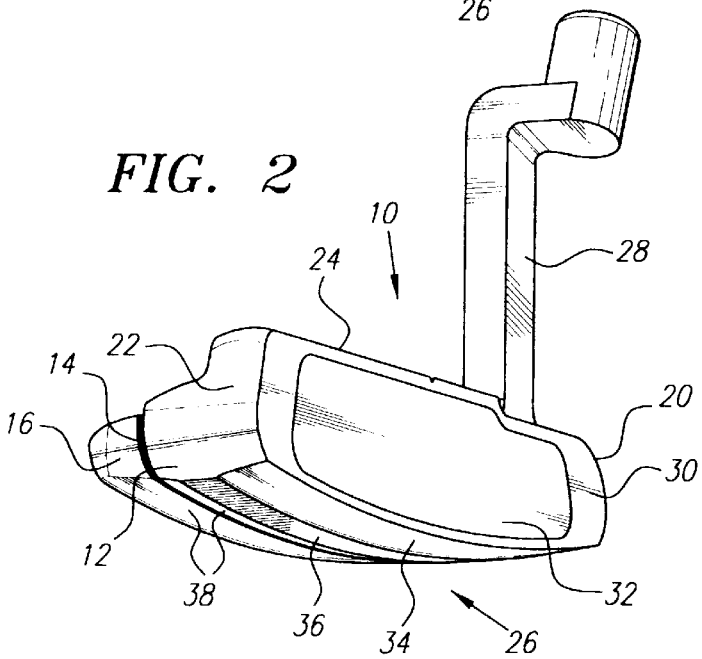
FIG. 2 is a front perspective view of the golf club head of the present invention having a polymer face insert in the main body.

FIG. 2 is a front perspective view of the club head 10 of the present invention. In a preferred embodiment, the club head 10 further comprises a front section 30 and a face insert 32. The bottom section 26 further comprises a front facet 34, a center facet 36 and a rear facet 38, also referred to herein as a tri-faceted sole. The face insert 32 is positioned centrally in the front section 30 of the club head 10. The face insert 32 is made of a third material which, in a preferred embodiment, is distinct from the first and second materials and is preferably made from a polymer material. The manufacturing method for incorporating a polymer face insert 32 into a club head 10 is discussed in U.S. Pat. No. 5,575,472, and is incorporated herein by reference.

FIGS. 3–8 are additional views of the club head 10 illustrating the various elements of the club head 10 including the tri-faceted sole (front facet 34, center facet 36 and rear facet 38), and specifically, the isolation layer 14, which is shown interposed between the main body 12 and weight body 16, wherein the weight body 16 is positioned low and rearward to provide the club head 10 with a low center of gravity.

Figure 3:
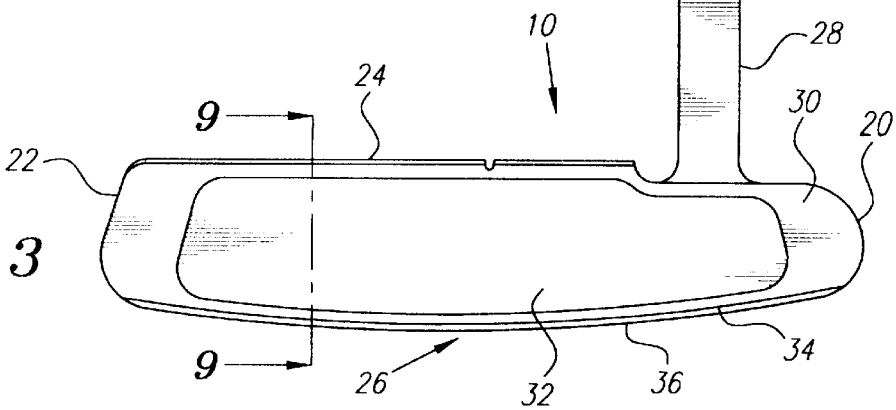
FIG. 3 is a front view of the golf club head of the present invention.
Figure 4:
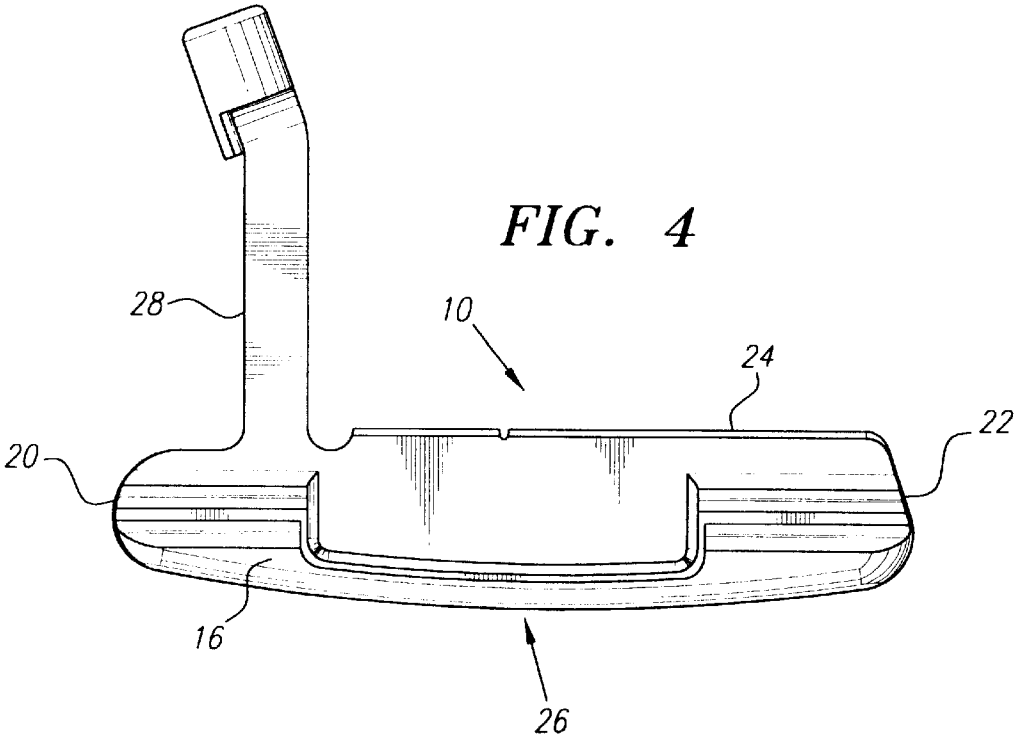
FIG. 4 is a rear view of the golf club head of the present invention.
Figure 9:
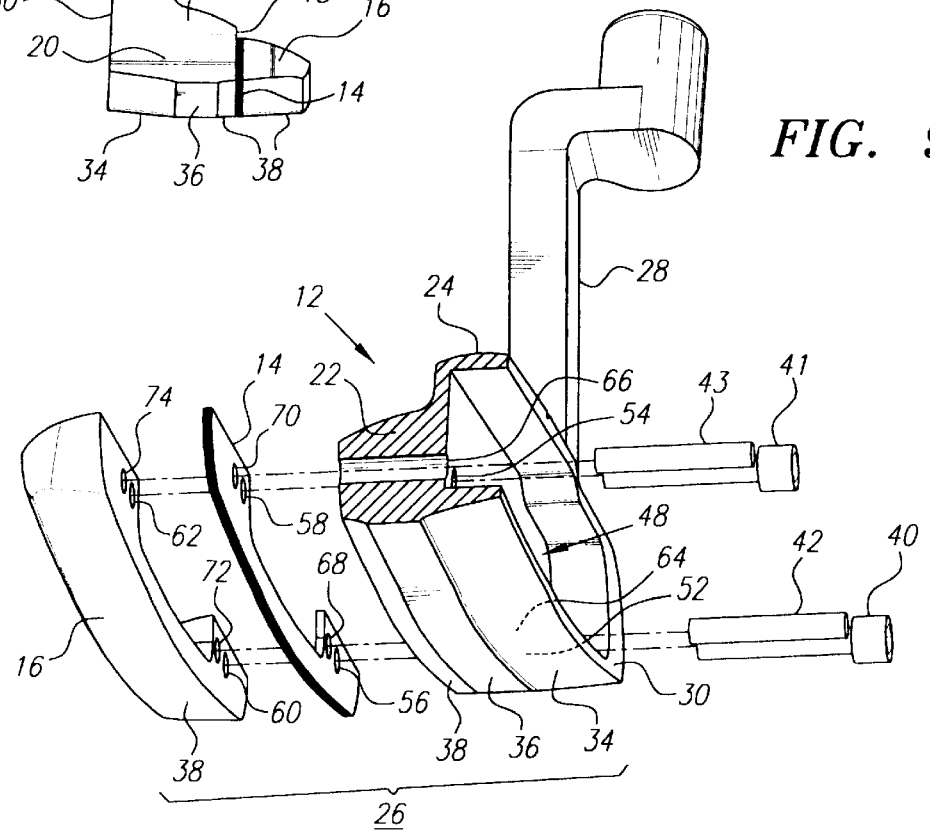
FIG. 9 is an exploded perspective view of the golf club head of the present invention.

FIG. 9 is an exploded bottom perspective view of the club head 10 of the present invention. The main body 12, prior to completion of manufacture, comprises a face cavity 48, which preferably is filled with a polymer face insert 32 (as better shown in FIG. 2) upon completion of manufacture. The main body 12 in FIG. 9 is shown in a cross-sectional view taken along the line 9—9 as shown in FIG. 3. The main body 12 further comprises a first and a second main body screw hole, 52 (not shown) and 54 respectively, and a first and a second main body alignment hole, 64 (not shown) and 66 respectively. The isolation layer 14 further comprises a first and a second isolation layer screw hole, 56 and 58 respectively, and a first and a second isolation layer alignment hole, 68 and 70 respectively. The weight body 16 further comprises a first and a second weight body screw recess, 60 and 62 respectively, and a first and a second weight body alignment recess, 72 and 74 respectively.

In a preferred embodiment, the main body 12, weight body 16 and isolation layer 14 are assembled in the following manner. The isolation layer 14 is positioned between the main body 12 rear section 18 and the weight body 16. It may be desirable to use an isolation layer that is coated with an adhesive such that it will make positioning the main body 12 and the weight body 16 relative to the isolation layer 14 an easier task. A first alignment pin 42 is placed through the face cavity 48, the first main body alignment hole 64, the first isolation layer alignment hole 68 and into the first weight body alignment recess 72, and the second alignment pin 43 is placed through the face cavity 48, the second main body alignment hole 66, the second isolation layer alignment hole 70 and into the second weight body alignment recess 74. This process ensures that the peripheral edges of the main body 12, isolation layer 14 and weight body 16 are properly aligned before screwing the components together.

The next steps include placing a first screw 40 through the face cavity 48, the first main body screw hole 52, the first isolation layer screw hole 56, and into the first weight body screw recess 60, and the second screw 41 is placed through the face cavity 48, the second main body screw hole 54, the second isolation layer screw hole 58, and into the second weight body screw recess 62. At this point, the first and second screws, 40 and 41 respectively, may be tightened to secure the weight body 16 to the main body 12 via the isolation layer 14.

Although the preferred embodiment described above focuses upon the application of an isolation layer between materials having differing densities in a putter head, it is understood that the present concept of an isolation layer can be readily adapted for implementation into a wood or wood-type golf club head design, an iron or iron-type golf club head design, as well as a putter head that does not incorporate a polymer face insert 32 or a tri-faceted sole. The terms "wood golf club head" and "iron golf club head" are understood to refer to commonly known classifications or types of golf clubs and is not limited to the material "wood" or the material "iron." For example, in an iron-type golf club head made of titanium, it may be desirable to incorporate a weighted plug, such as a tungsten plug, into one or more locations in the titanium head. If such a design were to result in a combination of impact vibration frequency patterns that resulted in producing a harsh or unpleasant feel, then the present patent application teaches the incorporation of an isolation layer between the titanium iron-type club head and the tungsten plug.

Furthermore, although the preferred embodiment described above focuses on the use of alignment pins and screws to attach the main body 12 to the weight body 16 via the isolation layer 14, it is understood that any of the various known means for attaching components in the manufacture and design of a golf club head may be utilized. For example, the components may be attached by welding, brazing, press fitting, gluing, or co-molding the components together, as well as incorporating an approach whereby the alignment pins and screws are inserted from the weight body 16 through the isolation layer 14 and into the main body 12.

What is claimed is:

1. A golf club head comprising:

a main body made of a first material;

a weight body made of a second material;

an isolation layer made of a third material;

said golf club head further comprising a ball striking front section, a rear section, a heel section, a toe section, a top section and a bottom section;

said weight body being attached to said main body with said isolation layer interposed between said weight body and said main body; and said isolation layer having a thickness greater than 0.030 inches.

2. The golf club head of claim 1, wherein said first material is stainless steel.

3. The golf club head of claim 1, wherein said first material is titanium.

4. The golf club head of claim 1, wherein said second material is tungsten.

5. The golf club head of claim 1, wherein said first material is stainless steel and said second material is tungsten.

6. The golf club head of claim 1, wherein said first material is titanium said second material is tungsten.

7. The golf club head of claim 1, wherein said first material has a first density and said second material has a second density, said first density being less than said second density.

8. The golf club head of claim 7, wherein said weight body is approximately 5% of the weight of said main body.

9. The golf club head of claim 7, wherein said weight body is approximately 25% of the weight of said main body.

10. The golf club head of claim 7, wherein said weight body is approximately 50% of the weight of said main body.

11. The golf club head of claim 7, wherein said weight body is approximately 75% of the weight of said main body.

12. The golf club head of claim 7, wherein said weight body is approximately 100% of the weight of said main body.

13. The golf club head of claim 7, wherein said weight body is approximately 200% of the weight of said main body.

14. The golf club head of claim 7, wherein said weight body is approximately 300% of the weight of said main body.

15. The golf club head of claim 7, wherein said ball striking front section further comprises a face insert differing in material from said main body.

16. The golf club head of claim 7, wherein said ball striking front section further comprises a polymer face insert.

17. The golf club head of claim 7, wherein said isolation layer comprises a metal having a third density differing from said first density and said second density.

18. The golf club head of claim 17, wherein said isolation layer is covered at least in part in an adhesive for simplifying the placement of said isolation layer between said weight body and said main body.

19. The golf club head of claim 1, wherein said isolation layer comprises a urethane.

20. The golf club head of claim 19, wherein said isolation layer is between 0.020 and 0.100 inches in thickness.

21. The golf club head of claim 19, wherein said isolation layer is between 0.30 and 0.40 inches in thickness.

22. The golf club head of claim 19, wherein said isolation layer is approximately 0.35 inches in thickness.

23. The golf club head of claim 19, wherein said isolation layer is covered at least in part in an adhesive for simplifying the placement of said isolation layer between said weight body and said main body.

24. The golf club head of claim 1, wherein said isolation layer comprises a polymer.

25. The golf club head of claim 22, wherein said isolation layer is covered at least in part in an adhesive for simplifying the placement of said isolation layer between said weight body and said main body.

26. The golf club head of claim 1 further comprising one or more screws, wherein said weight body is attached to said main body with said isolation layer interposed between said weight body and said main body via said one or more screws.

27. The golf club head of claim 26 further comprising one or more alignment pins, wherein positioning of said weight body, said isolation layer and said main body relative to one another is predetermined by insertion of said one or more alignment pins through said main body and said isolation layer and into said weight body.

28. The golf club head of claim 1, wherein said weight body is attached to said main body with said isolation layer interposed between said weight body and said main body via a welding means.

29. The golf club head of claim 1, wherein said weight body is attached to said main body with said isolation layer interposed between said weight body and said main body via a brazing means.

30. The golf club head of claim 1, wherein said weight body is attached to said main body with said isolation layer interposed between said weight body and said main body via a means of co-molding said main body integrally to said weight body.

31. The golf club head of claim 1, wherein said golf club head is a putter head.

32. The golf club head of claim 1, wherein said golf club head is an iron golf club head.

33. The golf club head of claim 1, wherein said golf club head is a wood golf club head.

34. The golf club head of claim 1, wherein said bottom section further comprises a front facet, a center facet and a rear facet, said center facet being positioned below a center of gravity of said golf club head.

35. A golf club head comprising:

a main body made of a first metal;

a weight body made of a second metal;

an isolation layer made of urethane;

one or more screws;

said golf club head further comprising a ball striking front section, a rear section, a heel section, a toe section, a top section and a bottom section;

said weight body being attached to said main body with said isolation layer interposed between said weight body by means of said one or more screws; and said isolation layer having a thickness greater than 0.030 inches.

36. The golf club head of claim 35, wherein said first metal is stainless steel and said second metal is tungsten.

37. The golf club head of claim 35, wherein said first metal is titanium and said second metal is tungsten.

38. The golf club head of claim 35 further comprising one or more alignment pins, wherein positioning of said weight body, said isolation layer and said main body relative to one another is predetermined by insertion of said one or more alignment pins through said main body and said isolation layer and into said weight body.

39. The golf club head of claim 35, wherein said front section further comprises a face insert differing in material from said main body.

40. The golf club head of claim 35, wherein said front section further comprises a polymer face insert.

41. A golf club head comprising:

a main body having a striking surface and a rear surface;

a polymer layer;

a minor body having a forward surface and a back surface; and the polymer layer is attached to the rear surface of the main body and the forward surface of the minor body.

42. The golf club head of claim 41 wherein the main body defines a first volume, the minor body defines a second volume where the first volume is larger than the second volume.

43. The golf club head of claim 42, wherein the polymer layer is a urethane.

44. The golf club head of claim 42, wherein the golf club head is a wood golf club head.

45. The golf club head of claim 42, wherein the golf club head is an iron golf club head.

46. The golf club head of claim 42, wherein the golf club head is a putter golf club head.

* * * * *